US005522364A

United States Patent [19]

Knight et al.

[11] Patent Number: 5,522,364

[45] Date of Patent: Jun. 4, 1996

[54] FUEL SYSTEMS

[75] Inventors: Andrew R. Knight, Buckinghamshire; Colin T. Timms; Ronald Phillips, both of Middlesex; Mark Smith, Hampshire, all of England

[73] Assignee: Lucas Industries, West Midlands, United Kingdom

[21] Appl. No.: 397,515

[22] Filed: Mar. 2, 1995

[30] Foreign Application Priority Data

Mar. 3, 1994 [GB] United Kingdom ..... 9404093

[51] Int. Cl.[6] ..... F02M 37/04

[52] U.S. Cl. ..... 123/467; 123/506

[58] Field of Search ..... 123/467, 506, 123/458, 449

[56] References Cited

U.S. PATENT DOCUMENTS

| | | | |
|---|---|---|---|
| 3,416,506 | 12/1968 | Steiger | 123/467 |
| 4,080,942 | 3/1978 | Vincent | 123/467 |
| 4,545,352 | 10/1985 | Jourdf | 123/467 |
| 4,603,671 | 8/1986 | Yoshinaga | 123/467 |
| 4,784,101 | 11/1988 | Iwanaga | 123/467 |
| 5,156,132 | 10/1992 | Iwanaga | 123/467 |
| 5,176,120 | 1/1993 | Takahashi | 123/467 |
| 5,186,151 | 2/1993 | Schwerdt | 123/467 |
| 5,277,163 | 1/1994 | Ohishi | 123/467 |

*Primary Examiner*—Carl S. Miller
*Attorney, Agent, or Firm*—Robbins, Berliner & Carson

[57] ABSTRACT

A pump/injector includes a high pressure pump which delivers fuel to an inwardly opening fuel injection nozzle. Also provided is a spill valve which is connected to the pumping chamber of the pump and through which the pumping chamber is filled with fuel from a source by way of a first non-return valve. Connected intermediate the spill valve and the non-return valve is a branch passage to the spring chamber of the nozzle and the pressure in the spring chamber when the spill valve is opened to terminate delivery of fuel is controlled by a valve.

6 Claims, 5 Drawing Sheets

FUEL SYSTEMS

This invention relates to a pump/injector for supplying fuel to a compression ignition engine and comprising a body, a bore formed at the body and defining with a reciprocable plunger a pump chamber from which fuel is expelled in timed relationship with the associated engine, a fuel injection nozzle including a fuel pressure actuated valve member which is biased into engagement with a seating by means of a spring housed within a spring chamber, the nozzle having a fuel inlet which is connected to the pump chamber, the valve member being lifted from the seating when fuel pressure at the inlet reaches a predetermined value to allow fuel flow from the inlet to an outlet and a spill valve operable to spill fuel expelled from the pump chamber to prevent delivery of fuel to the engine.

In the specification of GB-A-2105406 there is described a pump/injector of the kind set out above and in which the fuel which flows through the spill valve when it is opened to terminate delivery of fuel to the engine, flows into the spring chamber to increase the fuel pressure in order to assist closure of the valve member of the nozzle. Leading from the spring chamber is a drain passage which is provided with a restrictor. The restrictor acts to preserve the rise in pressure within the spring chamber. Modern engines have a wide spread range and it is not possible to choose a size of restrictor which is satisfactory at all engine speeds and loads.

The object of the invention is to provide such a pump injector in a simple and convenient form.

According to the invention in a pump/injector of the kind specified the spill valve has a first flow connection communicating with the pump chamber and the nozzle inlet and a second flow connection which is connected to a source of fuel under pressure by way of a non-return valve through which fuel can flow by way of the open spill valve to fill the pump chamber with fuel, a passage connecting the spring chamber with said second flow connection, and a valve operable to control the fuel pressure in said spring chamber.

Figure 1:
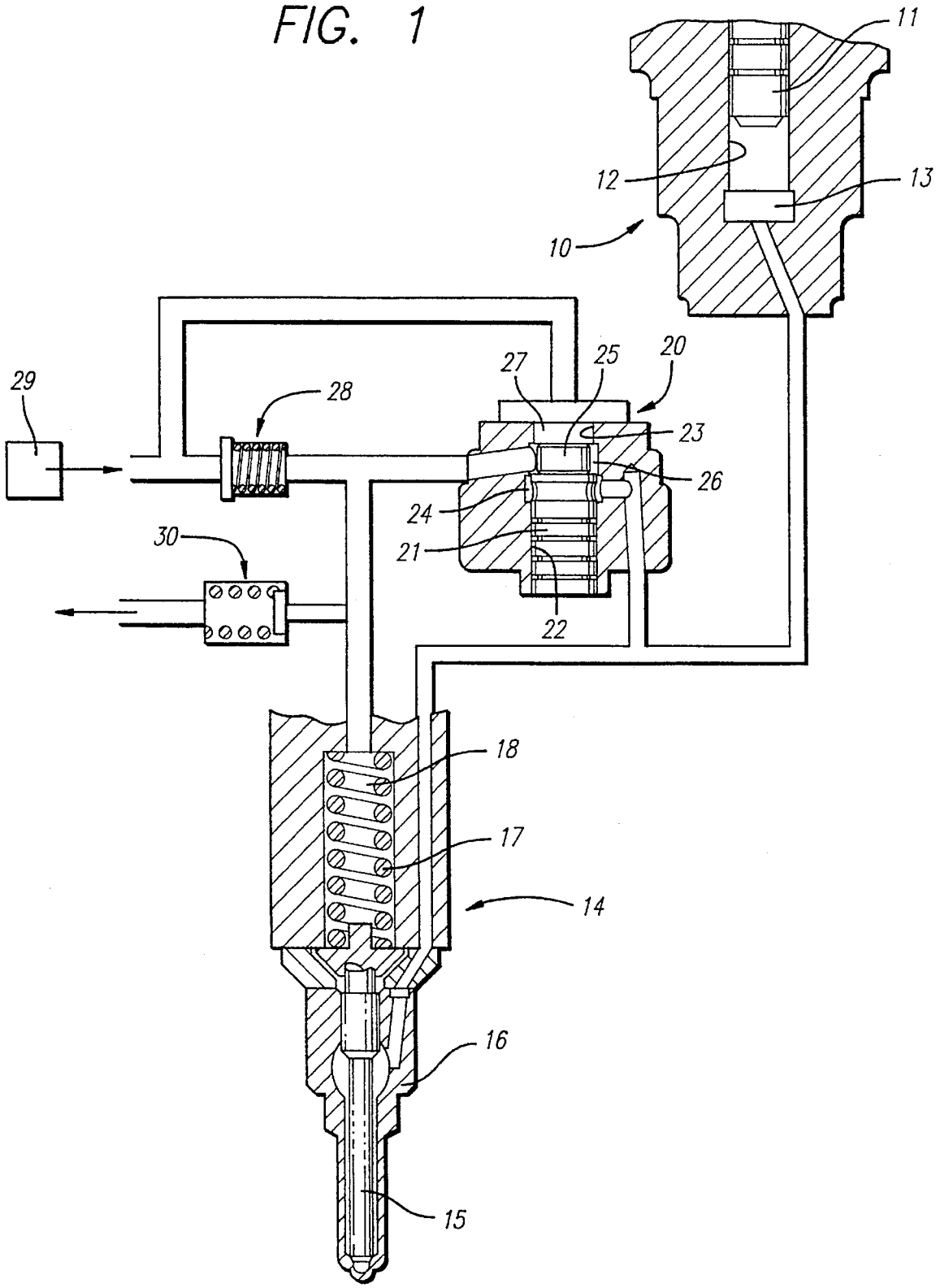
Figure 2:
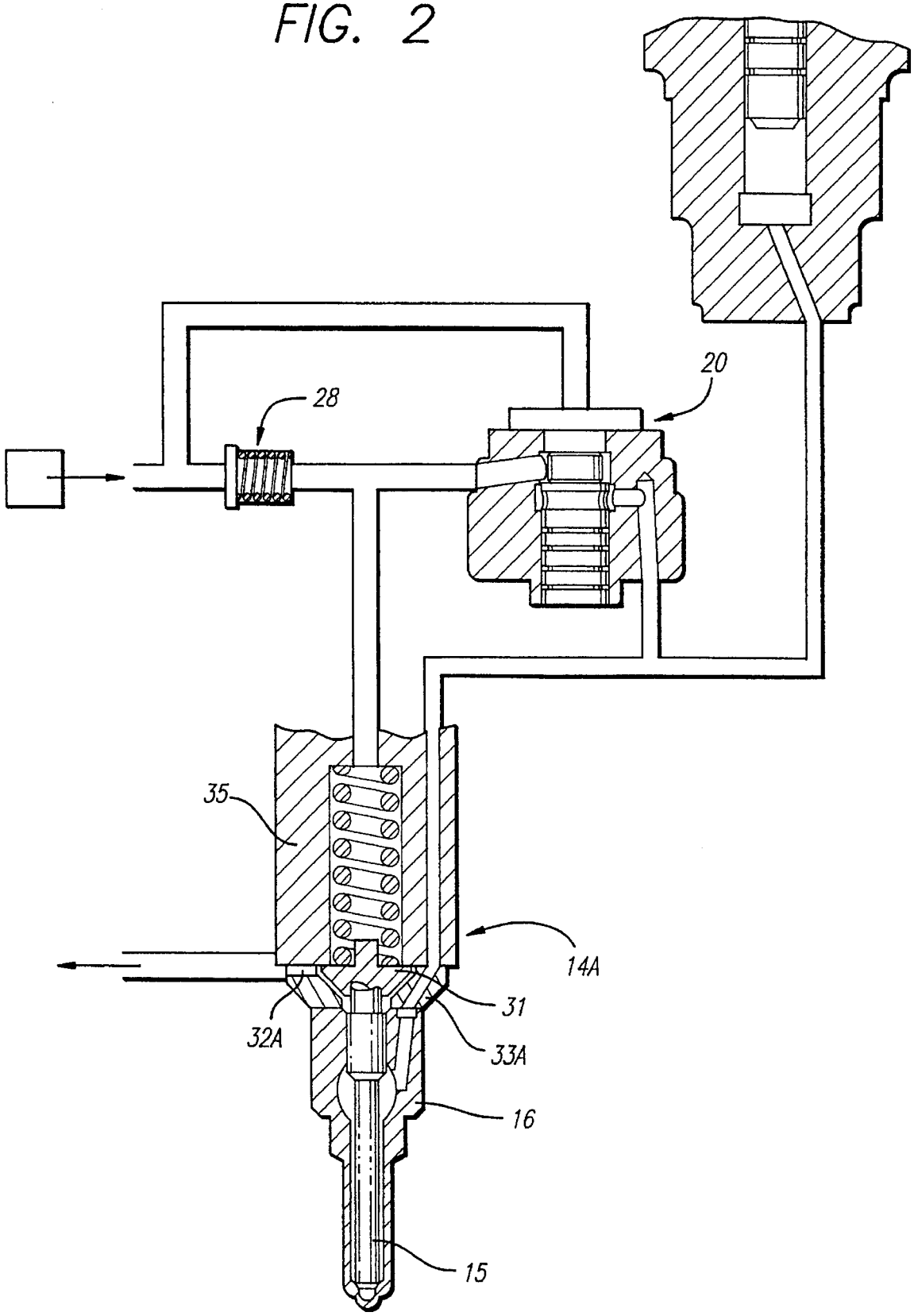
Figure 3:
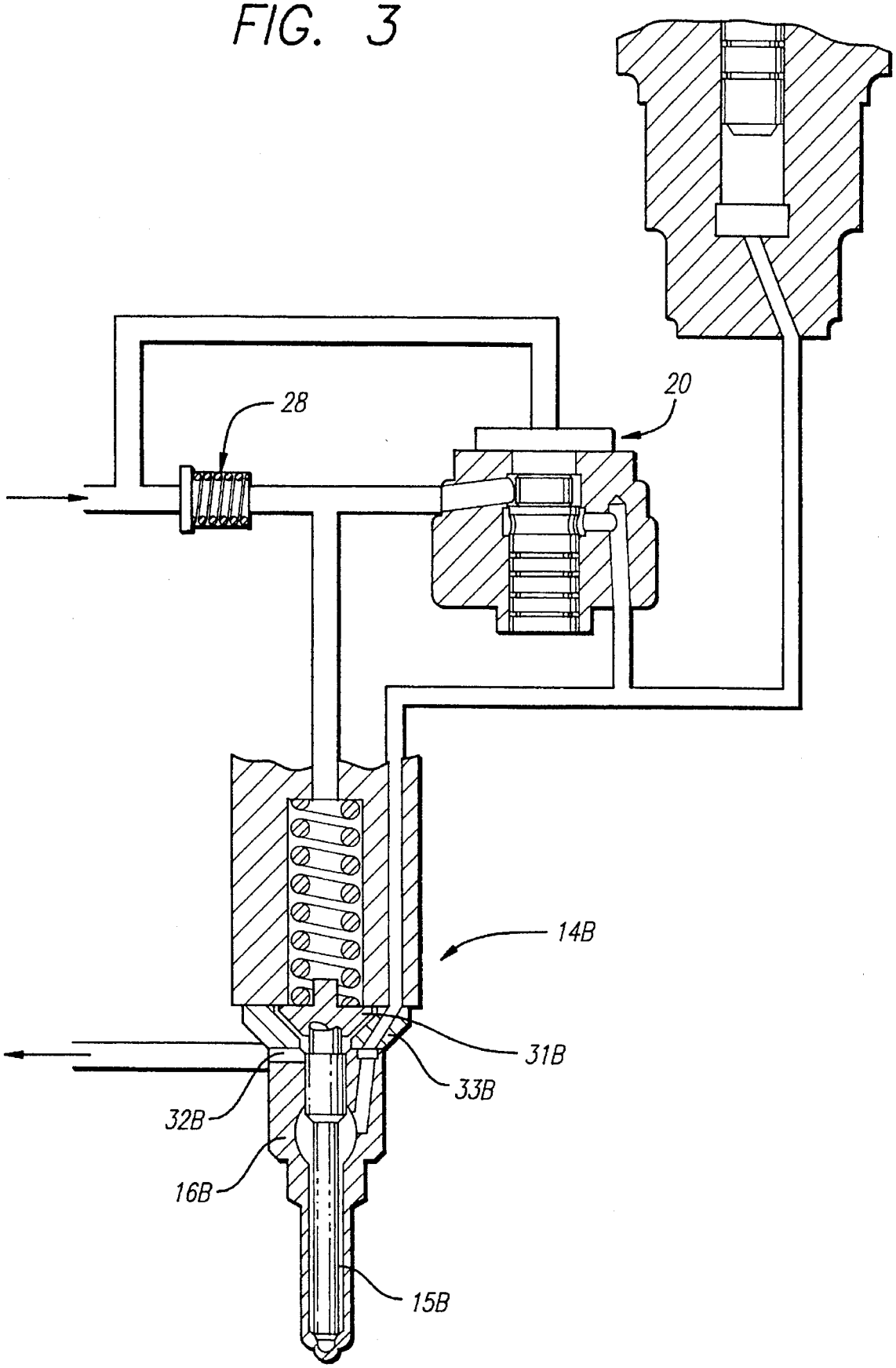
Figure 4:
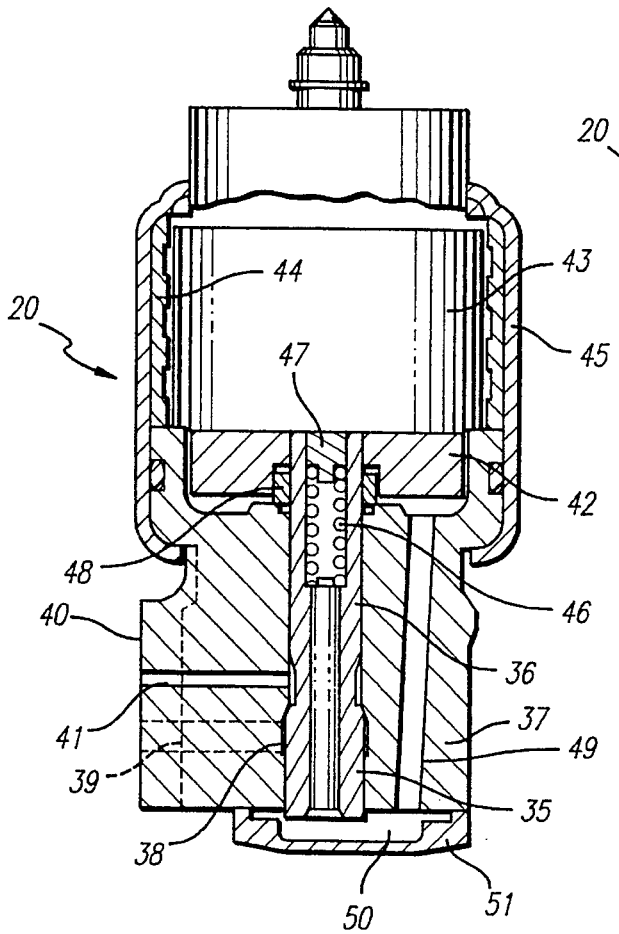
Figure 5:
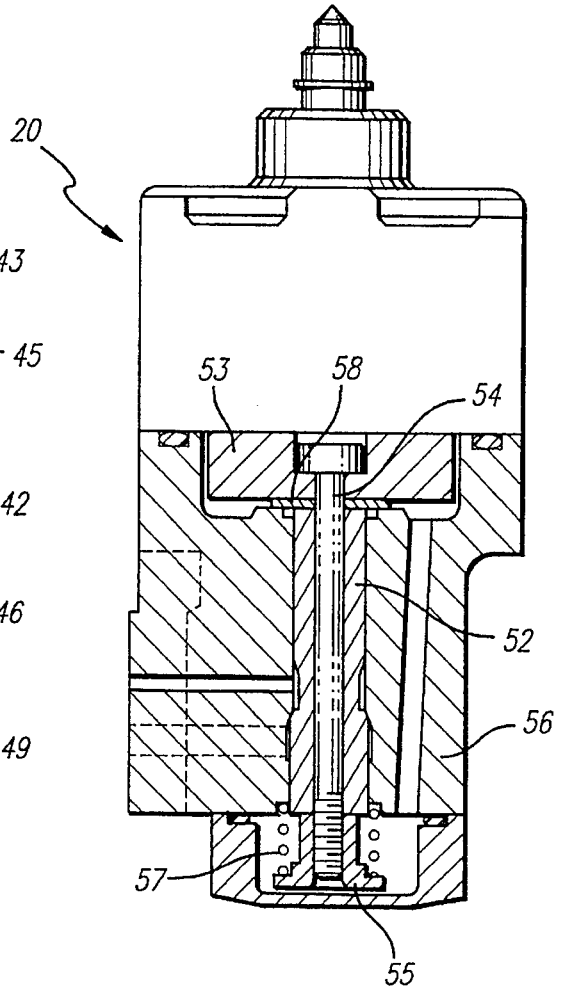
Figure 7:
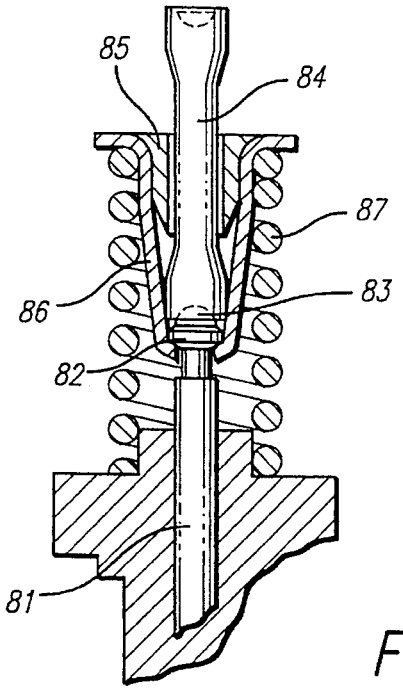
Figure 6:
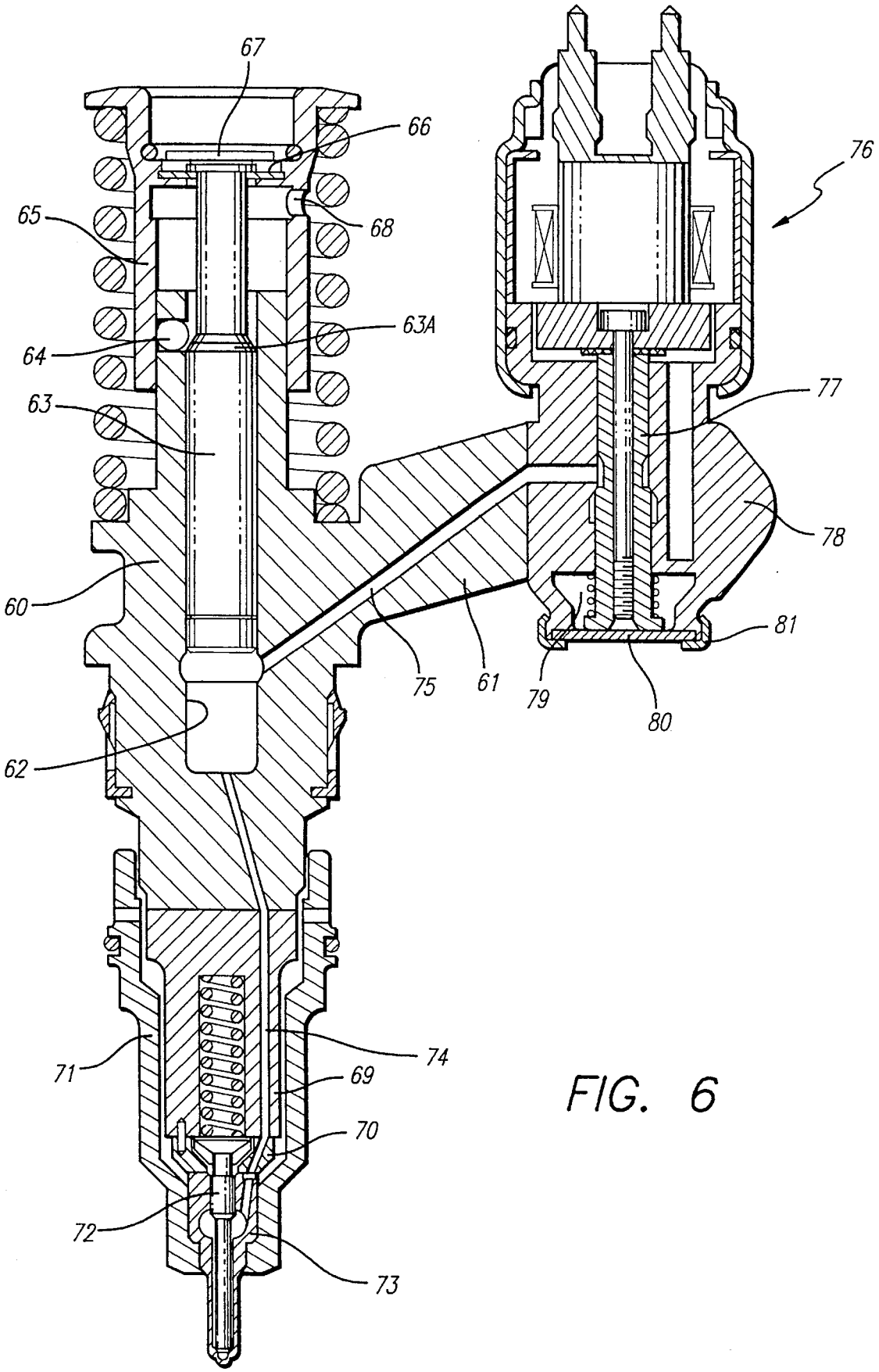

In the accompanying drawings:

FIG. 1 is a diagram showing the fuel circuit of one example of pump/injector, FIGS. 2 and 3 are views similar to FIG. 1 showing modifications to the fuel circuit, FIGS. 4 and 5 are sectional side elevations of two examples respectively of a spill valve for incorporation in the pump/injector, FIG. 6 is a sectional side elevation of one example of a pump/injector, and FIG. 7 is a side view of a modification to the pump/injector seen in FIG. 6.

With reference to FIG. 1 the pump/injector comprises a reciprocable plunger pump 10 which includes a pumping plunger 11 reciprocable in a bore 12 which with the plunger, defines a pump working chamber 13.

The pump/injector also includes a fuel injection nozzle 14 having a valve member 15 movable by fuel pressure away from a seating defined in a nozzle body 16 by means of fuel under pressure acting on an annular area of the valve member. The valve member is biased into engagement with the seating by means of a spring 17 which is located in a spring chamber 18 and when the valve member has been lifted from the seating fuel can flow from the pump working chamber 13 through an outlet orifice or orifices formed in a nozzle tip.

The pump/injector also includes a spill valve 20 which incorporates a spill valve member 21 movable axially within a bore 22. The bore 22 has a narrower portion 23 and at the junction of the bores there is defined an annular seating surface engagable by the spill valve member when an associated solenoid is energised. In the wider portion of the bore adjacent the seating surface there is formed a groove which communicates with the pump working chamber 13 and the valve member is also of reduced diameter to form a valve inlet chamber 24. The narrower portion 23 of the bore is also provided with a groove and the valve member with a reduced extension 25 to form a valve outlet chamber 26. At the end of the extension remote from the main portion of the valve member is a piston like member 27 which is a sliding fit within the narrower portion 23 of the bore.

The valve outlet chamber 26 communicates by way of a lightly loaded plate valve 28 with a source 29 of fuel under pressure, the plate valve being such as to permit flow of fuel towards the spill valve 20. The outlet chamber 26 of the spill valve is connected to the spring chamber 18 of the fuel injection nozzle 14 and in a branch passage from this connection is a further plate valve 30 arranged to allow flow of fuel to a drain. The loading of the plate valve 30 is substantially higher than that of the valve 28.

The spill valve member 20 is biased by a spring to the open position and is movable to the closed position in which it is shown, upon energising a solenoid in a valve actuator forming part of the valve. In operation, during inward movement of the pumping plunger 11 under the action of an engine driven cam, fuel is expelled from the pump working chamber 13 and if the spill valve 20 is open, flows by way of the valve 30 to drain. The pressure of the fuel is determined by the valve 30 and this pressure is applied to the valve member 15 of the fuel injection nozzle and assists the action of the spring 17 to keep the valve member in the closed position.

In order to obtain delivery of fuel to the engine, the solenoid associated with the spill valve 20 is energised and the valve member 21 is moved into engagement with the seating to prevent spillage of fuel. The pressure of the fuel which is applied to the annular area of the valve member 15 of the fuel injection nozzle is rapidly increased and when the pressure attains a high enough value the valve member is lifted from the seating to allow fuel flow to the engine. Such flow of fuel continues until the solenoid is again de-energised to allow the valve member 21 to lift from the seating. Apart from the fact that the fuel under pressure acting on the valve member of the fuel injection nozzle to maintain it in the open position is rapidly reduced, the shock wave which occurs as the spill valve 20 is opened, passes into the spring chamber 18 of the fuel injection nozzle and acts upon the valve member to assist the movement of the valve member to the closed position. Even when the shock wave and the resultant increased pressure have been dissipated through the valve 30, the latter acts to maintain the fuel pressure in the spring chamber 18 to assist the action of the spring in maintaining the valve member in the closed position.

When the pumping plunger 11 is allowed to move outwardly by the engine cam it does so under the action of a spring and fuel can then flow to the pump working chamber from the source 29 by way of the valve 28 and the open spill valve 20. The pump working chamber is completely filled with fuel prior to the next delivery of fuel.

In some engine applications it is required to deliver a pilot quantity of fuel to the engine in advance of the main quantity of fuel and this can be achieved by momentarily opening the spill valve 20 following its closure to achieve fuel delivery. The closure of the valve member 15 of the fuel injection nozzle takes place as described but when the spill valve member is again closed, the pressure in the spring chamber 18 will be higher than that when the spill valve was first closed because of the action of the valve 30 and because the pressure contained in the chamber may not have had time to dissipate. As a result the pressure required to open the fuel injection nozzle will be higher and this can be of substantial benefit.

In the arrangements which are shown in FIGS. 2 and 3 the valve 30 is replaced by a valve which is associated with the fuel injection nozzles 14A, 14B. In FIG. 2 the fuel injection nozzle 14A has a spring abutment 31 which in the fully open position of the valve member and the abutment as shown, obturates a spill passage 32A which is formed as a channel in the surface of a distance piece 33A interposed between the nozzle body 16 and a portion 35 of the body of the pump/injector. Prior to closure of the spill valve during inward movement of the pumping plunger 11, the pressure in the spring chamber 18 will be determined by amongst other things, the cross section of the spill passage 32A since the abutment 31 will be spaced from the portion 35 of the body. When the spill valve 20 is closed the pressure developed by the pump increases until it is sufficient to move the valve member 15 of the fuel injection nozzle against the action of the spring to allow fuel flow to the engine, such movement of the valve member causing the spring abutment 31 to obturate the spill passage 32A. When therefore the spill valve 20 is opened to terminate delivery of fuel to the engine the pressure wave which is generated is applied to the spring abutment thereby assisting the action of the spring to close the valve member of the fuel injection nozzle onto its seating. As the valve member of the fuel injection nozzle moves towards the closed position the spill passage 32A is opened to allow the remaining quantity of fuel to be spilled. The spring abutment has a larger area than the end area of the valve member.

In the arrangement shown in FIG. 3 the spring abutment 31B is provided with an axial slot and the valve member 15B of the fuel injection nozzle acts as a valve by reason of a spill passage 32B which is formed in the end face of the nozzle body 16B presented to the distance piece 33B. The inner end of the spill passage 32B is obturated when the valve member 15B is in the fully open position. The mode of operation of this example is the same as the example of FIG. 2 except that in this case the pressure wave acts on the end area of the valve member.

As will be seen from FIGS. 1, 2 and 3 the face of the piston like member 27 remote from the main portion of the valve member 21 of the spill valve is exposed within a chamber which is connected to the source 29 of fuel under pressure. Moreover in these examples the spill valve member is pushed onto its seating to close the valves.

The valve 30, and the corresponding valves in FIGS. 2 and 3 have the important advantage over the prior art in that they can be designed to function in an effective manner over the full range of engine speeds and loads. An important advantage is that the spring load can be reduced which will reduce the impact loading of the nozzle valve member 15 on the seating. In addition it is possible to reduce the differential area of the nozzle which means that for a given size of nozzle and valve member, the seating area can be increased which again reduces the impact loading.

FIGS. 4 and 5 illustrate examples of the spill valve 20 in which the valve member is pulled to the closed position and with reference to FIG. 4 the spill valve comprises a stepped tubular valve member 35 which is slidable within a stepped bore 36 formed in the spill valve body 37. The wider portion of the bore is formed with a circumferential groove 38 which communicates with a passage 39 extending to and opening onto a joint face 40. The steps defined in the bore and on the valve member are shaped to form seating surfaces and the portion of the narrower portion of the valve member adjacent the seating surface is of reduced diameter and connects with a passage 41 formed in the body and extending to the joint face 40. The passage 41 communicates with the source of fuel by way of the plate valve 28 and the passage 39 communicates with the pump working chamber. The valve member is coupled to an armature 42 which is part of the valve actuator, the actuator including a solenoid assembly 43 which comprises an "E" core and a winding. Conveniently the "E" core and the winding are potted within a casing 44 which is secured to the body 37 by means of a sleeve 45.

The valve member is biased to the open position by means of a spring 46 which acts between a step defined in the bore of the valve member and a fixed abutment 47 projecting from the solenoid assembly 43. The armature is an interference fit on the valve member and associated with the armature is an annular collar 48 which surrounds the valve member and which is an interference fit with the wall of a recess in the armature. The collar 48 can engage with a stop surface defined on the body 37 to determine the fully open position of the valve. In order to adjust the relative settings of the armature, the collar and the valve member, the valve member is first moved to the closed position and is then moved axially to the open position through a predetermined distance termed the valve lift. The armature 42 together with the collar are then pressed downwardly as shown in the drawings, until the end face of the armature which in use is presented to the pole faces of the "E" core lies a predetermined distance below the adjacent end surface of the body 37. During this movement the collar 48 moves into the recess in the armature due to its engagement with the body 37. Following adjustment the engagement of the collar 48 with the body determines the fully open position of the valve member and in the fully closed position of the valve member the armature 37 is separated from the pole faces of the "E" core when the solenoid assembly is in position, by a minimum air gap.

The space within the body 37 in which the armature is located is connected by means of a passage 49 formed in the body with a space 50 defined by a closure cap 51 which is secured to the body. By this means the opposite ends of the valve member are subjected to the same pressures. Moreover, by means of a passage not shown which opens onto the joint face 40 the aforesaid spaces can be connected to the source 29 of fuel under pressure.

The spill valve 20 which is shown in FIG. 5 has a valve member 52 which is secured to the armature 53 by means of a through bolt 54. The bolt extends through the valve member and a threaded portion thereof is engaged within a threaded bore formed in a flanged abutment 55. Interposed between the flange of the abutment and the body 56 of the valve is a return spring 57 which biases the valve member to the open position. The fully open position of the valve member is determined by the engagement of a shim 58 with the adjacent surface of the body and this surface or the end surface of the valve member must be ground to provide the required valve lift. The minimum air gap is determined by the thickness of the shim.

FIG. 6 shows in sectional side elevation a pump/injector having a main body 60 which is of generally cylindrical form with a lateral extension 61. Formed in the body in the particular example, is a blind bore 62 in which is slidably mounted a pumping plunger 63 which extends from the bore. The end portion of the plunger is of reduced diameter to define a shoulder 63A which is engagable by a ball 64 located in a lateral opening in the body 60. The ball is retained within the opening by the skirt portion 65 of a flanged spring abutment slidably mounted about the body. A plunger return spring 66 is interposed between the spring abutment and the body and the plunger is coupled to the spring abutment by a circlip 66 which is interposed between a head on the plunger and an inwardly extending flange on the abutment. The spring abutment also carries a thrust plate 67 which in the use of the pump/injector is engaged by an engine cam actuated component such as a rocker. The ball 64 once located in position acts to prevent the plunger, the abutment and the spring becoming detached in transit. It is not intended to form a plunger stop in the use of the pump/injector. The ball is placed in position through on opening 68 in the skirt of the spring abutment with the spring compressed and the spring abutment rotated through 180°

The fuel injection nozzle body is formed in three parts 69, 70, 73 and these are secured to the body 60 by means of a cap nut 71. The part 69 is of cylindrical form and is provided with a blind bore which forms a spring chamber and serves to accommodate a return spring for a fuel pressure actuated nozzle valve inwardly opening member 72 which is located in the part 73. The valve member carries a spring abutment which is engaged with the spring and the movement of the valve member against the action of the spring is limited by the engagement of the spring abutment with the part 70 of the body. The valve member at its end remote from the spring is shaped for engagement with a frusto conical seating against which it is urged by the action of the spring to prevent fuel flow to a small sac volume which is located downstream of the seating and from which extend outlet orifices. The valve member 72 defines an annular area which is exposed to the fuel pressure in a fuel gallery surrounding the valve member, the gallery being connected by a passage 74 in the parts 69, 70 and 73 with the blind end of the bore 62. The blind end of the bore 62 is also connected by a passage 75 in the body part 60 to the spill valve 76.

The spill valve 76 is similar in construction to the spill valve shown in FIG. 5. In this case however the flanged abutment 55 is formed integrally with the valve member 77. Moreover, the body 78 is extended to form a chamber 79 which surrounds the extended portion of the valve member and the open end of this chamber is closed by a plate 80 which is held in position by a retaining band 81. The potted "E" core and the winding are retained on the spill valve body 78 in the same manner as in the example of FIG. 4 and the body 78 of the spill valve is conveniently machined from bar stock with the joint surface being produced by a milling operation.

FIG. 6 illustrates only the passage 75 which conveys fuel at high pressure from the bore 62 when the spill valve is opened during inward movement of the pumping plunger and which also conveys fuel to the bore during outward movement of the plunger. A further passage is formed in the body 60, the extension 61 and the spill valve body and which connects the spill valve with the plate valve 28 and the spring chamber of the nozzle and a still further passage is provided which connects the spaces within the spill valve with the source of fuel under pressure. As with most pump/injectors the main body of the injector is located in a bore in the cylinder head of the engine and the fuel under pressure is derived from a fuel supply gallery formed in the cylinder head. The valve 28 is conveniently located in the body 60 as also is the valve 30. The fuel injection nozzle arrangement shown in FIG. 6 may be replaced by either of the arrangements shown in FIGS. 2 and 3 where the separate valve 30 is not used. The formation of the spill valve body 78 from bar stock allows sufficient room on the joint face for the passages identified above and also for the provision of bolts which secure the valve body to the lateral extension 61.

In the modification shown in FIG. 7 the plunger 81 is provided with a head 82 on the surface of which remote from the main portion of the plunger is a hemispherical projection 83. This is engaged within a complementary recess formed in one end of a push rod 84. The opposite end of the push rod is provided with a similar recess which in use is engaged by an engine cam actuated member such as a rocker. Intermediate its ends the push rod 84 is of reduced diameter and extends with clearance through the tubular bush 85 which is a friction fit within a spring abutment 86. The spring abutment is of hollow frusto conical form having an outwardly extending flange at its wider end with the narrower end being engaged about the head 82 of the plunger. The plunger return spring 87 is interposed between the flange and the body of the pump/injector. The spherical joints at the opposite ends of the push rod allow the axes of the plunger and the push rod to move out of line in the use of the pump/injector and the action of the bush 85 is to provide location of the push rod in the event that the plunger should stick and the components of one or both joints should separate.

We claim:

1. A pump/injector for supplying fuel to a compression ignition engine comprising a body, a bore formed in the body and defining with a reciprocable plunger a pump chamber from which fuel is expelled in timed relationship with the associated engine, a fuel injection nozzle including a fuel pressure actuated valve member which is biased into engagement with a seating by means of a spring housed in a spring chamber, the nozzle having a fuel inlet which is connected to the pump chamber, the valve member being lifted from the seating when the fuel pressure at the inlet reaches a predetermined value to allow fuel flow from the inlet to an outlet, a spill valve operable to spill fuel expelled from the pump chamber to prevent delivery of fuel to the engine the spill valve having a first flow connection communicating with the pump chamber and the nozzle inlet and a second flow connection which is connected to a source of fuel under pressure by way of a non-return valve through which fuel can flow by way of the open spill valve to fill the pump chamber with fuel, a passage connecting the spring chamber with said second flow connection and a pressure control valve operable to control the fuel pressure in the spring chamber, the fuel pressure in the spring chamber acting upon a surface associated with the valve member to assist the action of the spring.

2. A pump/injector according to claim 1, in which the pressure control valve comprises a further non-return valve.

3. A pump/injector according to claim 1, in which the pressure control valve is defined by a part of the valve member of the nozzle said part in the open position of the valve member obturating a port, the port being opened as the valve member moves towards the closed position.

4. A pump/injector according to claim 2, in which said surface is defined by an end surface of the valve member.

5. A pump/injector according to claim 1, including a spring abutment interposed between the valve member and the spring said spring abutment in the fully open position of the valve member acting to close the adjacent end of the spring chamber whereby when the spill valve is opened the fuel pressure in the spring chamber acts on a surface of the abutment, the abutment as it moves with the nozzle valve member under the action of the spring and the pressure acting on said surface, opens a port to allow fuel to escape from the spring chamber.

6. A pump/injector according to claim 3, in which said surface is defined by an end surface of the valve member.

* * * * *